US006791468B2

(12) United States Patent
Stippler

(10) Patent No.: US 6,791,468 B2
(45) Date of Patent: Sep. 14, 2004

(54) REMOTE CONTROL, REMOTELY CONTROLLABLE DEVICE AND REMOTE CONTROL CONFIGURATION

(75) Inventor: Michael Stippler, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 469 days.

(21) Appl. No.: 09/894,676

(22) Filed: Jun. 28, 2001

(65) Prior Publication Data

US 2002/0018002 A1 Feb. 14, 2002

(30) Foreign Application Priority Data

Jun. 28, 2000 (DE) ..... 100 31 468

(51) Int. Cl.[7] ..... G08C 19/00

(52) U.S. Cl. ..... 340/825.69; 340/825; 340/72; 367/197; 455/352

(58) Field of Search ..... 340/825.69, 825.51, 340/825.72, 825.63; 367/197; 455/352; 358/194.1; 307/118

(56) References Cited

U.S. PATENT DOCUMENTS 5,047,765 A * 9/1991 Munekata ..... 340/825.57

FOREIGN PATENT DOCUMENTS

| | | | | |
|---|---|---|---|---|
| DE | 4300600 A1 | | 7/1994 | |
| DE | 196 34 487 A1 | | 3/1998 | |
| DE | 196 35 279 A1 | | 3/1998 | |
| DE | 19635279 | * | 3/1998 | ..... H04Q/9/00 |

* cited by examiner

*Primary Examiner*—Michael Horabik
*Assistant Examiner*—M Shimizu
(74) *Attorney, Agent, or Firm*—Laurence A. Greenberg; Werner H. Stemer; Gregory L. Mayback

(57) ABSTRACT

A remote control, particularly for wireless remote control of a closing device in a motor vehicle, has a first transmitter for outputting an optical signal, and a second transmitter for outputting a radio signal. The two transmitters are able to be activated for signal output by at least one actuation element. An input of the first transmitter and/or of the second transmitter is connected to a clock transmitter in order to output the optical signal and/or the radio signal in pulsed fashion at particular intervals of time in order to save energy. Also an associated remotely controllable device and a full remote control configuration are disclosed.

12 Claims, 3 Drawing Sheets

| IR | RF | ZV | KS |
|---|---|---|---|
| 0 | 0 | 0 | 0 |
| 0 | 1 | 1 | 0 |
| 1 | 0 | 0 | 0 |
| 1 | 1 | 1 | 1 |

| IR | RF | ZV | KS |
|---|---|---|---|
| 0 | 0 | 0 | 0 |
| 0 | 1 | 1 | 0 |
| 1 | 0 | 1 | 0 |
| 1 | 1 | 1 | 1 |

REMOTE CONTROL, REMOTELY CONTROLLABLE DEVICE AND REMOTE CONTROL CONFIGURATION

BACKGROUND OF THE INVENTION

FIELD OF THE INVENTION

The invention relates to a remote control having a first transmitter for outputting an optical signal and a second transmitter outputting a radio signal. The two transmitters can be activated for signal output by at least one actuation element. A remotely controllable device is also described and has a first receiver for detecting the optical signal and a second receiver for detecting the radio signal. The remotely controllable device further has a mechanical control element for activating a closing function and the control element is activated by the first receiver and/or the second receiver. The invention further relates to a remote control configuration containing both the remote control and the remotely controllable device, particularly for wireless remote control of a closing device in a motor vehicle.

Published, Non-Prosecuted German Patent Application DE 43 00 600 A1 discloses a remote control configuration for wireless remote control of a closing device in a motor vehicle, where the closing device of the motor vehicle can perform two different closing functions, namely normal central locking for all the doors and "added-feature locking", in which, additionally, all the windows and a sunroof which may be present are closed. For safety reasons, on the basis of EU guideline 74/60/EC, added-feature locking can be carried out only if there is a visual link between the remote control and the motor vehicle, so that the user can use the available visual link to check that nobody is injured when the window or the sunroof is closed. The known remote control configuration therefore has two communication paths between the remote control and the motor vehicle, one communication path being based on radio transmission, while the other communication path is based on infrared transmission in order to ensure visual contact between the remote control and the motor vehicle. In this context, added-feature locking is triggered only if both a radio signal and an infrared signal are received from the remote control, which precludes activation of added-feature locking without visual contact between remote control and motor vehicle. In contrast, normal central locking is activated even when only a radio signal is received from the remote control.

The drawback of the known remote control configuration is the fact that the infrared transmitter requires a relatively large amount of current (e.g. 20 mA), and therefore there is a relatively high loading on the battery of the remote control when added-feature locking is activated by remote control.

SUMMARY OF THE INVENTION

It is accordingly an object of the invention to provide a remote control, a remotely controllable device and a remote control configuration which overcomes the above-mentioned disadvantages of the prior art devices of this general type, in which current consumption of the remote control when added-feature locking is activated is reduced, but where added-feature locking must likewise be possible only if there is a visual link between the remote control and the remotely controlled device.

With the foregoing and other objects in view there is provided, in accordance with the invention, a remote control containing two transmitters including a first transmitter outputting an optical signal and a second transmitter outputting a radio signal, the two transmitters each having an input. At least one actuation element for signal activating the two transmitters is provided. A clock transmitter is connected to the input of the first transmitter and/or the second transmitter for outputting the optical signal and/or the radio signal in a pulsed fashion at particular intervals of time in order to save energy. The clock transmitter is further connected to the actuation element.

The invention contains the general technical disclosure of performing signal transmission from the remote control to the remotely controllable device in pulsed fashion in order to reduce the current consumption when the remotely controllable device is activated. The remote control therefore has two transmitters whose inputs are connected to a clock transmitter in order to output the optical signal or the radio signal in a pulsed fashion at particular intervals of time in order to save energy. In this context, the optical signal and the radio signal are preferably transmitted cyclically at constant intervals of time, but acyclic transmission of the signals, for example at randomly selected intervals of time, is also possible.

In the preferred embodiment, the first transmitter, which outputs the optical signal, is connected to the first clock transmitter, and the second transmitter, which outputs the radio signal, is connected to the second clock transmitter. In order to output the optical signal, on the one hand, and the radio signal, on the other hand, at different intervals of time, the intervals of time between successive optical signals are longer than the intervals of time between successive radio signals. This is based on the realization that the current consumption when transmitting the optical signal is much higher than the current consumption when transmitting the radio signal. Therefore, the optical signal should be transmitted at longer intervals of time in order to reduce the current consumption. In contrast, the radio signal is transmitted at relatively short intervals of time in order to achieve a rapid response from the remote control to turning-off by the user. The interval of time between successive optical signals is preferably longer than 300 ms, and is 600 ms in the preferred embodiment. In contrast, the interval of time between successive radio signals is preferably shorter than 100 ms, and is merely 30 ms in the preferred embodiment.

In the preferred embodiment, the remote control has two mutually independent actuation elements, for example in the form of push-button switches, which, in the security device mentioned initially for a motor vehicle, allow separate activation of added-feature locking and of central locking, for example. The radio signal transmitter disposed in the remote control is in this case preferably connected to both actuation elements via an OR element, so that the radio signal is output when at least one of the two actuation elements is activated by the user. In contrast, the transmitter for the optical signal is preferably connected exclusively to the associated actuation element, and is therefore activated only when the actuation element is activated by the user.

However, it is also possible for added-feature locking, on the one hand, and normal central locking, on the other hand, to be activated independently of one another using a single actuation element. For this purpose, one variant of the invention provides an actuation element which, in the event of brief actuation for less than 1 s, for example, activates only normal central locking or only the radio transmitter, whereas added-feature locking or the optical transmitter is activated only when the actuation element is actuated for a longer period of time.

With the foregoing and other objects in view there is further provided, in accordance with the invention, a remotely controllable device containing two receivers including a first receiver for detecting an optical signal and a second receiver for detecting a radio signal. At least one mechanical control element for activating a closing function is provided. The mechanical control element is activated by the first receiver and/or the second receiver. A holding element is connected downstream of one of the two receivers and to the mechanical control element. The holding element has a holding time being longer than an interval of time between successive signals so that the mechanical control element is not deactivated in intervals of time between the successive signals upon pulsed transmission of the optical signal and of the radio signal.

In addition, the scope of the invention provides an appropriately matched remotely controllable device that has a first receiver for detecting the optical signal and has a second receiver for detecting the radio signal. In addition, the remotely controllable device has a mechanical control element for activating a corresponding function, the control element being activated by the first receiver and/or by the second receiver. In this case, at least one of the two receivers has a holding element connected downstream of it, the holding time of the holding element being longer than the interval of time between successive signals so that the control element is not deactivated in the intervals of time between successive signals upon pulsed transmission (described above) of the optical signal or of the radio signal. In other words, the holding element thus bridges the interval of time between successive signals.

In this context, each receiver preferably has a holding element connected downstream of it, the holding time of the holding element associated with the receiver for the optical signal being longer than the holding time of the holding element associated with the receiver for the radio signal, since the optical signals are preferably transmitted at longer intervals of time in order to reduce the current consumption.

To activate a first closing function (e.g. added-feature locking), the inventive remotely controllable device preferably has a first control unit, and to activate a second closing function (e.g. normal central locking), it has a second control unit, the two control units being connected to the two holding elements via a logic circuit. Preferably, the logic circuit has an AND gate whose inputs are connected to the two holding elements and whose output is connected to the first control unit in order to activate the first closing function (e.g. added-feature locking) only when there is a visual link between the remote control and the remotely controllable device. In one variant of the invention, the logic circuit has, between the holding elements and the control units, an OR gate whose inputs are connected to the two holding elements and whose output is connected to the second control unit, so that the second closing function (e.g. normal central locking) is activated when the radio signal and/or the optical signal is received.

In addition, the invention also contains a full remote control configuration including the remote control described above and the remotely controllable device likewise described above.

Other features which are considered as characteristic for the invention are set forth in the appended claims.

Although the invention is illustrated and described herein as embodied in a remote control, a remotely controllable device and a remote control configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
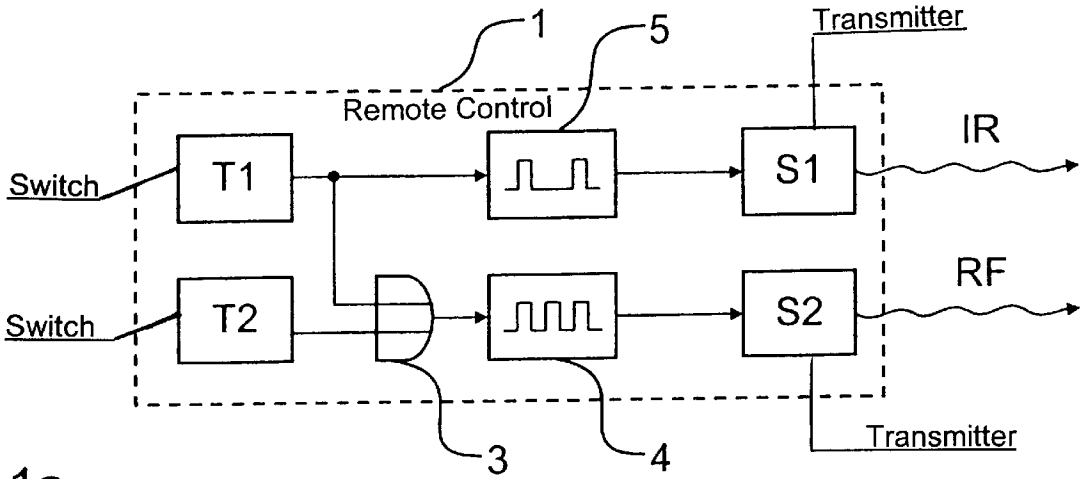
FIG. 1*a* is a block diagram of a remote control device in accordance with the invention.

In all the figures of the drawing, sub-features and integral parts that correspond to one another bear the same reference symbol in each case. Referring now to the figures of the drawing in detail and first, particularly, to FIG. 1*a* thereof, there is shown a block diagram showing an inventive remote control 1 for controlling a closing device 2 of a motor vehicle. The closing device 2 is shown in the form of a block diagram in FIG. 1*b* and controls a plurality of mechanical control elements SG1–SG4. In this case, the control elements SG1 and SG2 are used for locking doors, whereas the control elements SG3 and SG4 are used for closing windows and a sunroof. The closing device 2 shown permits conventional central locking by virtue of the mechanical control elements SG1 and SG2 locking the doors. In addition, the closing device 2 also permits "added-feature locking", in which all the doors are locked and the windows and the sunroof are closed. In this case, the central locking is activated by a control unit ZV whose output is connected to the two control elements SG1 and SG2, whereas added-feature locking is activated by a further control unit KS, whose output is connected to all the control elements SG1–SG4.

For safety reasons, added-feature locking can be activated only if there is a visual link between the remote control 1 and the closing device 2 so that the operator of the remote control 1 can check whether, when the windows and the sunroof are closed by the control elements SG3, SG4, there is a risk of injury to anyone situated in the danger area. The remote control 1 and the closing device 2 therefore communicate over two communication paths by virtue of both an infrared signal IR and a radio signal RF being transmitted from the remote control 1 to the closing device 2.

In this context, the transmission of the infrared signal IR from the remote control 1 to the closing device 2 ensures that there is a visual link between the remote control 1 and the closing device 2.

To activate central locking or added-feature locking, the remote control 1 has two push-button switches T1, T2, the push-button switch T1 permitting activation of the added-feature locking, whereas the push-button switch T2 is used for activating normal central locking.

An output of the push-button switch T2 is connected via an OR gate 3 to a pulse transmitter and generator 4 which produces a square-wave pulse train having a period of $T_{RF}$=30 ms and thus controls a transmitter S2 for outputting a radio signal RF. The radio signal RF output by the transmitter S2 thus contains a pulse train having a period duration of $T_{RF}$=30 ms.

To receive the radio signal RF, the closing device 2 has a receiver E2 whose output is connected to a holding element HG2. The holding element HG2 has a holding time of $T_{H2}$=40 ms, so that the output of the holding element HG2 always produces a high level during reception of the radio signal RF from the transmitter S2. At the output, the holding element HG2 is in turn connected to the control unit ZV, which, when a high level is produced at the output of the holding element HG2, controls the control elements SG1 and SG2, which then lock the doors of the motor vehicle. In summary, it is noted that actuation of the push-button switch T2 results in activation of the central locking, irrespective of the existence of a visual link between the remote control 1 and the closing device 2.

The output of the push-button switch T1 is connected via the OR gate 3 to the pulse transmitter 4 for the radio signal RF and to the control input of a further pulse transmitter 5, which, upon activation of the push-button switch T1, produces a square-wave pulse train having a period duration of $T_{IR}$=600 ms, and thus controls an infrared transmitter S1. When the push-button switch T1 is actuated, the remote control 1 thus outputs both an infrared signal IR having a period duration of $T_{IR}$=600 ms and a radio signal RF having a period duration of $T_{RF}$=30 ms. The infrared signal IR and the radio signal RF are received in the closing device 2 by the two receivers E1 and E2, the output of the receiver E1 being connected to a holding element HG1 which has a holding time of $T_{H1}$=800 ms, so that a high level appears at the output of the holding element HG1 so long as the infrared signal IR is being transmitted by the transmitter S1 in the remote control 1. The output of the holding element HG1 is connected via an AND gate 6 to a control unit KS whose output controls all the control elements SG1–SG4. The important aspect here is that the control unit KS is controlled, in order to activate the control elements SG1–SG4 and hence for the purposes of added-feature locking, only when a high level is produced both at the output of the holding element HG1 and at the output of the holding element HG2, i.e. when the closing device 2 receives both the infrared signal IR and the radio signal RF from the remote control 1. This ensures that added-feature locking is triggered only when there is a visual link between the remote control 1 and the closing device 2 so that the user of the remote control can check whether there is any risk of injury.

The relatively long period duration of the infrared signal IR of $T_{IR}$=600 ms advantageously results in a relatively low current consumption when added-feature locking is activated. Despite this, the operator of the remote control 1 can quickly terminate added-feature locking, because the radio signal RF has only a relatively short period duration of $T_{RF}$=30 ms. The remote control configuration according to the invention thus combines the advantages of low current consumption owing to a relatively long period duration of the infrared signal IR and a rapid response owing to the relatively short period duration of the radio signal RF.

Figure 1B:
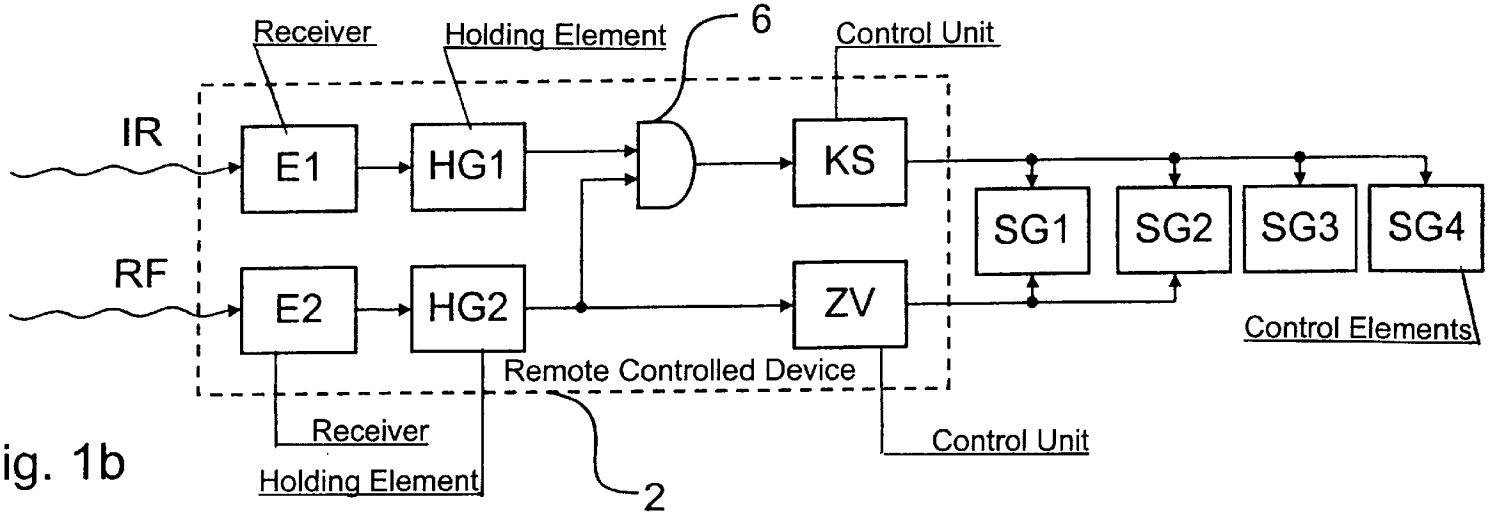
FIG. 1*b* is a block diagram of a remotely controllable device.
Figures 1C, 2A, 2B:
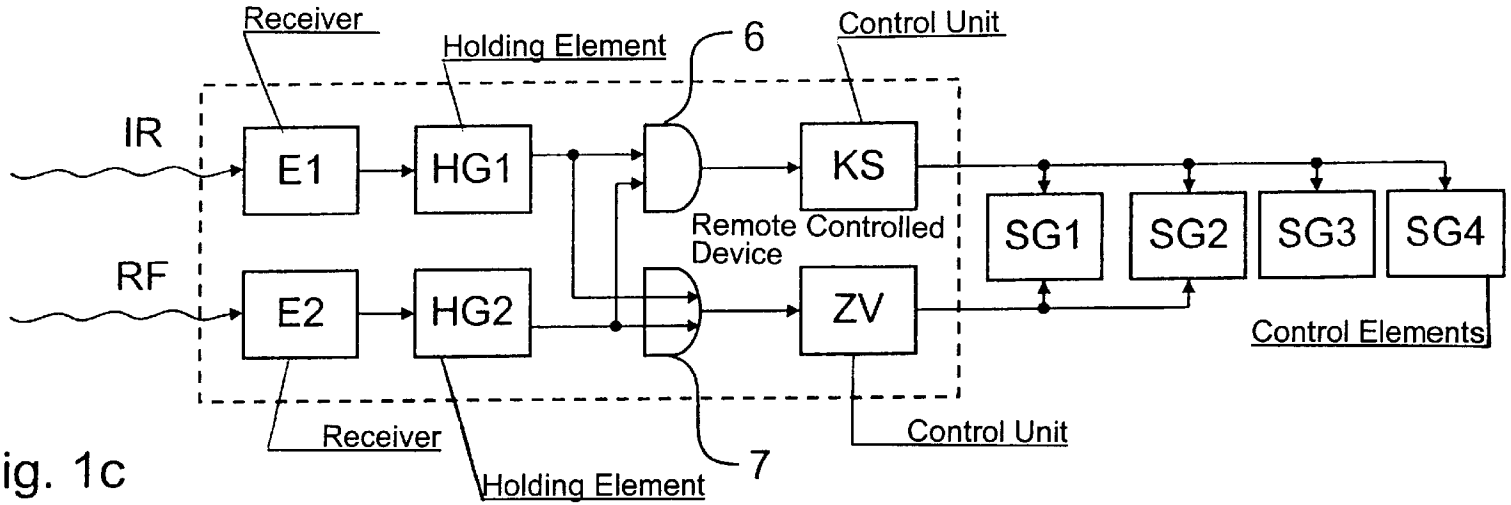
FIG. 1*c* is a block diagram of a variant of the remotely controllable device.
FIGS. 2*a* and 2*b* are logic tables showing an allocation of an optical signal and a radio signal to an activation of a central locking and of an added-feature locking.
Figure 3:
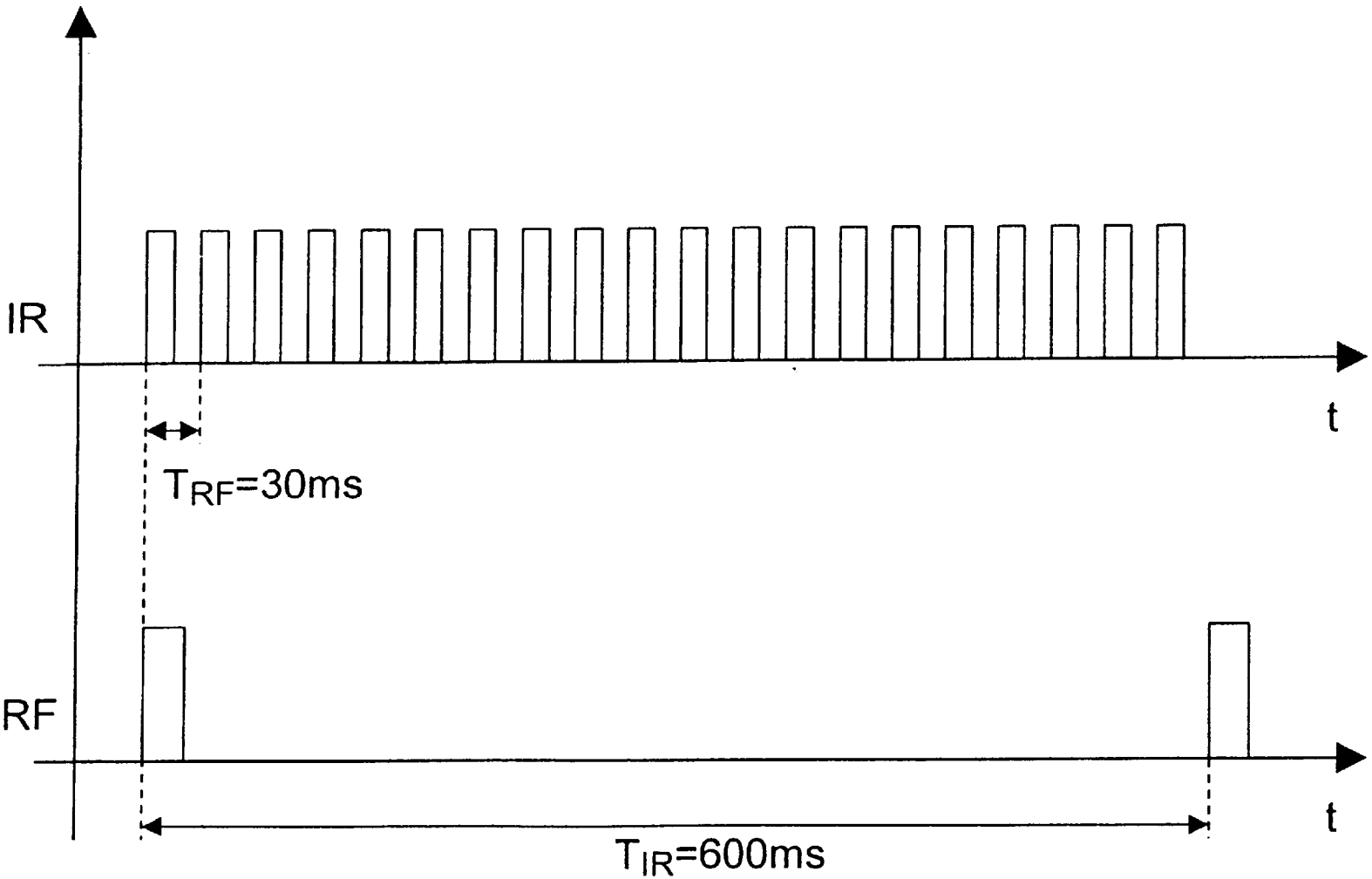
FIG. 3 is a pulse graph for the optical signal and for the radio signal.

FIG. 2*a* shows the response of the closing device 2 on the basis of reception of the infrared signal IR and of the radio signal RF, where column ZV shows activation of central locking, and column KS shows activation of added-feature locking.

FIG. 1*c* shows an alternative exemplary embodiment of the inventive closing device which largely concurs with the exemplary embodiment shown in FIG. 1*b*, so that the text below uses the same reference symbols and reference is made to the description relating to FIG. 1*b* in this regard, in order to avoid unnecessary repetition.

The difference between the exemplary embodiment shown in FIG. 1*c* and the exemplary embodiment shown in FIG. 1*b* is that an OR gate 7 is additionally disposed between the holding elements HG1, HG2 and the two control units KS, ZV. The output of the OR gate 7 is connected to the control unit ZV, and the inputs of the OR gate 7 is connected to the holding element HG1 and to the holding element HG2. This produces the response shown in the form of a logic table in FIG. 2*b* from the closing device 2, in that central locking is also activated when only the infrared signal IR, but not the radio signal RF, is received.

The invention is not limited to the exemplary embodiments described above. Instead, a large number of variants and modifications are conceivable which make use of the inventive principle and therefore lie within the scope of protection.

I claim:

1. A remote control, comprising:

two transmitters including a first transmitter outputting an optical signal and a second transmitter outputting a radio signal, said two transmitters each having an input;

two actuation elements including a first actuation element and a second actuation element, said first actuation element activating said first transmitter, said second actuation element activating said second transmitter;

two clock transmitters, including a first clock transmitter and a second clock transmitter, outputting the optical signal and the radio in pulsed fashion at particular intervals of time for saving energy, said first transmitter connected to said first clock transmitter and said second transmitter connected to said second clock transmitter, the optical signal and the radio signal being output at different intervals of time, a first interval of time between successive optical signals being longer than a second interval of time between successive radio signals, said two clock transmitters further coupled to said two actuation elements; and an OR gate connected to said two actuation elements and to said second transmitter for activating said second transmitter when at least one of said two actuation elements is actuated.

2. The remote control according to claim 1, wherein the first interval of time between the successive optical signals is longer than 300 ms.

3. The remote control according to claim 1, wherein the second interval of time between the successive radio signals is shorter than 100 ms.

4. The remote control according to claim 1, wherein in an event of a brief actuation, said actuation elements actuate only said second transmitter, and in an event of an actuation for a period of time longer than the brief actuation, said actuation elements actuate said first transmitter.

5. The remote control according to claim 1, wherein said two transmitters provide a wireless remote control of a closing device in a motor vehicle.

6. The remote control according to claim 4, wherein the brief actuation is an actuation of less than one second.

7. A remotely controllable device, comprising:

two receivers including a first receiver for detecting an optical signal and a second receiver for detecting a radio signal;

at least one mechanical control element for activating a closing function, said mechanical control element being activated by at least one of said first receiver and said second receiver; and two holding elements including a first holding element with a first holding time and a second holding element with a second holding time, said first holding element connected between said first receiver and said mechanical control element, said second holding element connected between said second receiver and said mechanical control element, the first holding time being longer than a first interval of time between successive optical signals, and the second holding time being longer than a second interval of time between successive radio signals so that said mechanical control element is not deactivated in intervals of time between the successive signals upon pulsed transmission of the optical signal and of the radio signal.

8. The remotely controllable device according to claim 7, containing:

control units including a first control unit for activating a first closing function and a second control unit for activating a second closing function; and a logic element connected between said two control units and said two holding elements.

9. The remotely controllable device according to claim 8, wherein said logic circuit has an AND gate with inputs connected to said two holding elements and an output connected to said first control unit to activate the first closing function only when there is a visual link.

10. The remotely controllable device according to claim 9, wherein said logic circuit has an OR gate with inputs connected to said two holding elements and an output connected to said second control unit.

11. The remotely controllable device according to claim 7, wherein said receivers, said mechanical control element and said holding elements form a wirelessly remotely controllable closing device in a motor vehicle.

12. A remote control configuration, comprising:

a remote control, comprising:

two transmitters including a first transmitter outputting an optical signal and a second transmitter outputting a radio signal, said transmitters each having an input;

at least one actuation element for signal activating said two transmitters; and a clock transmitter connected to at least one of said input of said first transmitter and said input of said second transmitter to output at least one of the optical signal and the radio signal in pulsed fashion at particular intervals of time to save energy, said clock transmitter further connected to said actuation element; and a remotely controllable device wirelessly controlled by said remote control, containing:

two receivers including a first receiver for detecting the optical signal and a second receiver for detecting the radio signal;

at least one mechanical control element for activating a closing function, said mechanical control element being activated by at least one of said first receiver and said second receiver; and two holding elements including a first holding element with a first holding time and a second holding element with a second holding time, said first holding element connected between said first receiver and said mechanical control element, said second holding element connected between said second receiver and said mechanical control element, the first holding time being longer than a first interval of time between successive optical signals, and the second holding time being longer than a second interval of time between successive radio signals so that said mechanical control element is not deactivated in intervals of time between the successive signals upon pulsed transmission of the optical signal and of the radio signal.

* * * * *